US010481538B2

(12) United States Patent
Ohshika

(10) Patent No.: US 10,481,538 B2
(45) Date of Patent: Nov. 19, 2019

(54) IMAGE FORMATION APPARATUS HAVING A USED CONDITION DETECTOR

(71) Applicant: Oki Data Corporation, Tokyo (JP)

(72) Inventor: Hirotaka Ohshika, Tokyo (JP)

(73) Assignee: Oki Dota Corporation, Tokyo (JP)

( * ) Notice: Subject to any disclaimer, the term of this patent is extended or adjusted under 35 U.S.C. 154(b) by 0 days.

(21) Appl. No.: 15/957,081

(22) Filed: Apr. 19, 2018

(65) Prior Publication Data

US 2018/0307172 A1 Oct. 25, 2018

(30) Foreign Application Priority Data

Apr. 21, 2017 (JP) ..... 2017-84195

(51) Int. Cl.
*G03G 15/00* (2006.01)
*G03G 15/08* (2006.01)

(52) U.S. Cl.
CPC ..... *G03G 15/556* (2013.01); *G03G 15/5016* (2013.01); *G03G 15/553* (2013.01); *G03G 15/652* (2013.01); *G03G 15/0856* (2013.01)

(58) Field of Classification Search
None
See application file for complete search history.

(56) References Cited

U.S. PATENT DOCUMENTS

2002/0071690 A1* 6/2002 Muramatsu ..... G03G 15/50 399/82
2007/0146398 A1* 6/2007 Igarashi ..... B41J 2/17566 347/7
2010/0158549 A1* 6/2010 Shiraishi ..... G03G 15/553 399/45
2016/0202657 A1* 7/2016 Koseki ..... G03G 21/10 399/35
2017/0255130 A1* 9/2017 Ui ..... G03G 15/0894

FOREIGN PATENT DOCUMENTS

JP 2016-044026 A 4/2016

* cited by examiner

*Primary Examiner* — Victor Verbitsky
(74) *Attorney, Agent, or Firm* — Metrolex IP Law Group, PLLC

(57) ABSTRACT

An image formation apparatus according to an embodiment includes: a medium conveyance device that conveys a continuous medium; an image formation unit that forms a developer image on the medium to print on the medium; a used condition detector that detects a used condition of the image formation unit; and a controller that controls the medium controller, the image formation unit, and the used condition detector. When it is determined that the image formation unit comes to a time for replacement during a printing operation, the controller selects whether to continue the printing operation based on the detection by the used condition detector.

10 Claims, 9 Drawing Sheets

IMAGE FORMATION APPARATUS HAVING A USED CONDITION DETECTOR

CROSS REFERENCE TO RELATED APPLICATIONS

This application claims priority based on [35] USC 119 from prior Japanese Patent Application No. JP2017-084195 filed on Apr. 21, 2017, entitled "IMAGE FORMATION APPARATUS", the entire contents of which are incorporated herein by reference.

BACKGROUND

The disclosure relates to an image formation apparatus that forms images on a continuous medium.

There is an image formation apparatus that performs continuous printing by forming images on a continuous medium unwound from a roll of medium (see Patent Literature 1, for example).

Patent Literature 1: Japanese Patent Application No. 2016-44026

SUMMARY

In the related art, however, a user replaces a consumable part in the image formation apparatus with a new one while temporarily stopping the printing, when the consumable comes to the end of its life or the time for replacement. The image formation apparatus has to discharge the last printed page by conveying the continuous medium when stopping the printing, and does not print on a portion of the continuous medium between the last printed page and the next first printed page. The image formation apparatus accordingly produces a useless portion of the medium (waste paper portion). An object of an embodiment of this disclosure is to inhibit production of a useless part of a medium when a consumable comes to the time for replacement.

An aspect of this disclosure is an image formation apparatus that includes: a medium conveyance device that conveys a continuous medium; an image formation unit that forms a developer image on the medium to print on the medium; a used condition detector that detects a used condition of the image formation unit; and a controller that controls the medium conveyance device, the image formation unit, and the used condition detector. When it is determined that the image formation unit comes to a time for replacement during a printing operation, the controller selects whether to continue the printing operation based on a result of the detection by the used condition detector.

According to the aspect, it is possible to inhibit production of a useless portion of a medium in a case where a consumable comes to the time for replacement.

DETAILED DESCRIPTION

Figure 1:
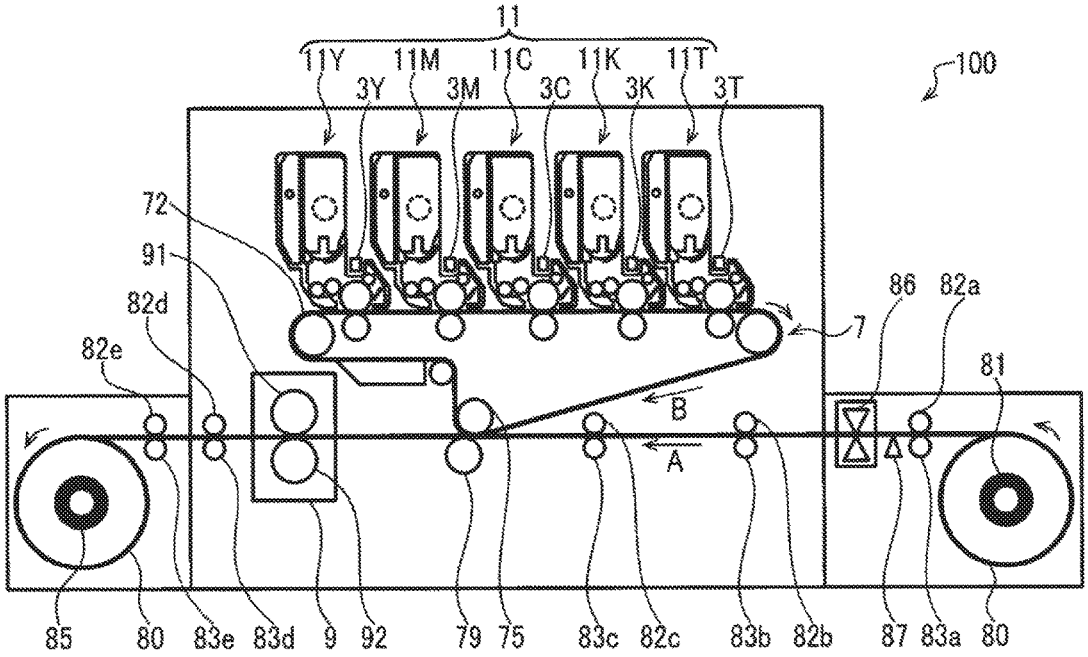
FIG. 1 is a schematic side cross-sectional view illustrating a configuration of an image formation apparatus according to an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only. An image formation apparatus according to one or more embodiments is explained with reference to the drawings.

FIG. 1 is a schematic side cross-sectional view illustrating a configuration of an image formation apparatus according to an embodiment. The image formation apparatus 100 illustrated in FIG. 1 performs continuous printing on a continuous print medium. The image formation apparatus 100 is, for example, an intermediate transfer-type printer including an intermediate transfer unit 7. The image formation apparatus 100 performs continuous printing on a continuous print medium unwound from a roll of print medium (hereinafter referred to as "roll/roll printing").

The image formation apparatus 100 includes a medium holder 81, conveyance rollers 82*a* to 82*e*, pinch rollers 83*a* to 83*e*, the intermediate transfer unit 7, developing units 11, a secondary transfer roller 79, a fixation unit 9 (or a fusing unit), a winding holder 85, a cutter unit 86, and a medium detection sensor 87.

The medium holder 81 holds a print medium 80 that is wound in a roll. The conveyance rollers 82*a* to 82*e* each works as a medium conveyance device and conveys the print medium 80 while drawing the print medium 80 from the medium holder 81. The pinch rollers 83*a* to 83*e* are arranged facing the conveyance rollers 82*a* to 82*e* with a medium conveyance path interposed in between. The pinch rollers 83*a* to 83*e* and the conveyance rollers 82*a* to 82*e* hold the print medium 80 between them.

The conveyance roller 82*a* and the pinch roller 83*a* are arranged facing each other; the conveyance roller 82*b* and the pinch roller 83*b* are arranged facing each other; the conveyance roller 82*c* and the pinch roller 83*c* are arranged facing each other; the conveyance roller 82*d* and the pinch roller 83*d* are arranged facing each other; and the conveyance roller 82*e* and the pinch roller 83*e* are arranged facing each other. The conveyance roller 82*a* and the pinch roller 83*a*, the conveyance roller 82*b* and the pinch roller 83*b*, the conveyance roller 82*c* and the pinch roller 83*c*, the conveyance roller 82*d* and the pinch roller 83*d*, and the conveyance roller 82*e* and the pinch roller 83*e* are placed in this order from the upstream to the downstream in a medium conveyance direction indicated by an arrow A in FIG. 1.

The intermediate transfer unit 7 works as an intermediate transfer device and is placed above the medium conveyance path. The intermediate transfer unit 7 conveys toner images that the developing units 11 form on a belt 72.

The developing units 11 work as an image formation unit and is placed above the intermediate transfer unit 7. A developing unit 11Y using yellow toner, a developing unit 11M using magenta toner, a developing unit 11C using cyan toner, a developing unit 11K using black toner, and a developing unit 11T using feature color toner are placed in this order from the upstream to the downstream in a belt conveyance (rotation) direction indicated by an arrow B in FIG. 1.

The developing units 11 form the toner images that are transferred onto and printed on the print medium 80. The developing units 11 form the toner images on the belt 72. The toner images are developer images using toners that work as developers, respectively. Incidentally, the developing unit 11T is explained as a developing unit using white toner. The developing unit 11T may use clear toner, gold toner, silver toner, neon toner or the like instead of white toner.

The image formation apparatus 100 includes the five developing units. Instead, however, the image formation apparatus 100 may include four or less developing units, or six or more developing units. Light sources 3Y, 3M, 3C, 3K, 3T work as exposure devices, and are placed above the developing units 11Y, 11M, 11C, 11K, 11T.

The light sources 3Y, 3M, 3C, 3K, 3T each are an LED (Light Emitting Diode) head which includes LEDs arranged in a main scanning direction. Incidentally, the light sources 3Y, 3M, 3C, 3K, 3T each may be that which emits a laser beam. The secondary transfer roller 79 works as a transfer device and is arranged facing a support roller 75 of the intermediate transfer unit 7 with the belt 72 interposed in between. The secondary transfer roller 79 transfers the toner images, which the belt 72 conveys, onto the print medium 80.

The fixation unit 9 or a fusing unit is placed downstream of the secondary transfer roller 79 in the medium conveyance direction. By applying heat and pressure to the toners transferred on the print medium 80, the fixation unit 9 fixes the toners to the print medium 80.

The winding holder 85 is placed downstream of the fixation unit 9 in the medium conveyance direction and winds the print medium 80 on which the fixation unit 9 fixes the toners. The cutter unit 86 is arranged between the conveyance rollers 82*a*, 82*b*, and with the medium conveyance path passing through the cutter unit 86. The cutter unit 86 cuts the print medium 80 that the conveyance rollers 82*a* to 82*e* convey along the medium conveyance path. The medium detection sensor 87 is a sensor that is arranged under the medium conveyance path and upstream of the cutter unit 86 in the medium conveyance direction, and that detects the print medium 80.

Figure 2:
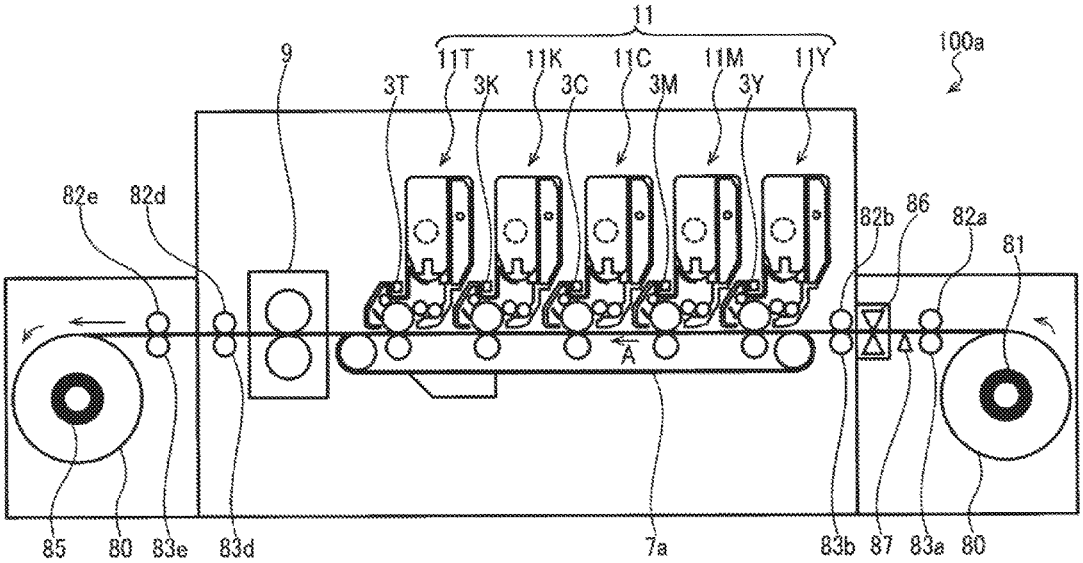
FIG. 2 is a schematic side cross-sectional view illustrating a configuration of an image formation apparatus (direct transfer type) according to a modification.

The image formation apparatus 100 is an intermediate transfer-type printer, but does not necessarily to be limited to the intermediate transfer-type printer. Like an image formation apparatus 100*a* according to a modification illustrated in FIG. 2, the image formation apparatus 100 may be a direct transfer-type printer that includes a transfer belt 7*a*, and that directly transfers toner images, which the developing units 11 form, onto the print medium 80 that the transfer belt 7*a* conveys.

Figure 3:
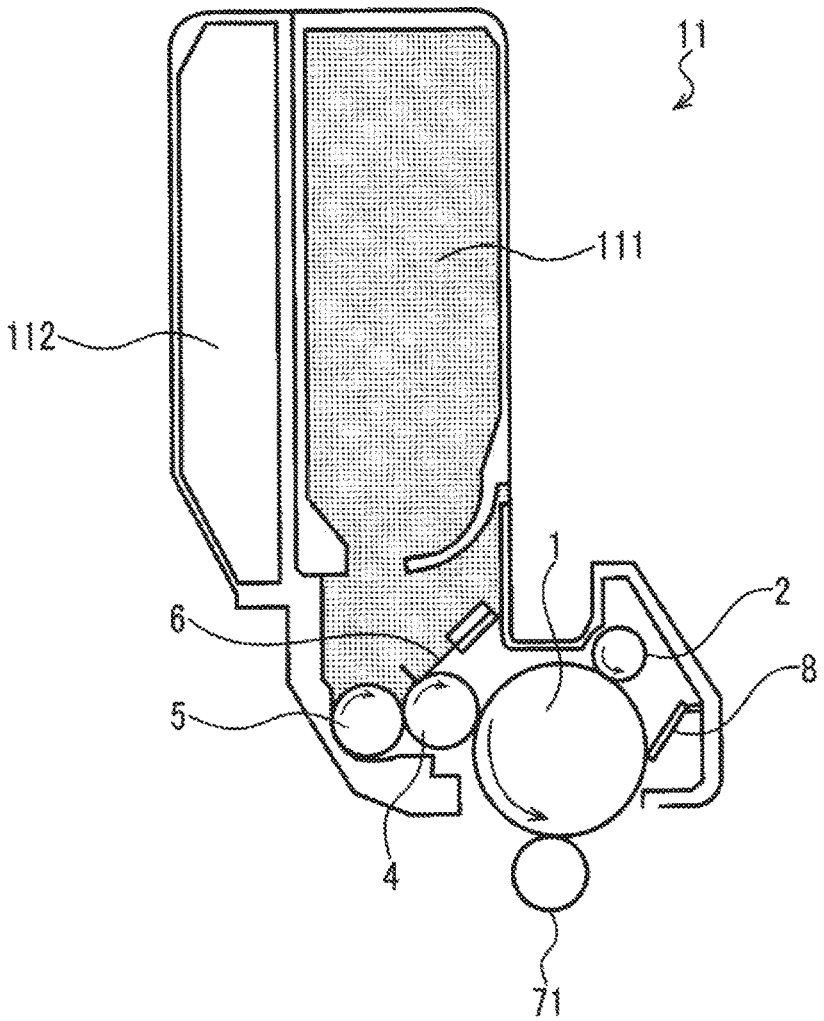
FIG. 3 is a schematic side cross-sectional view illustrating a configuration of a developing unit of the image formation apparatus illustrated in FIG. 1.

FIG. 3 is a schematic side cross-sectional view illustrating a configuration of one developing unit 11. The developing units 11Y, 11M, 11C, 11K, 11T illustrated in FIG. 1 have the same configuration although using their respective different toners, and descriptions are provided for the configuration of one developing unit 11 that represents the developing units 11Y, 11M, 11C, 11K, 11T.

In FIG. 3, the developing unit 11 includes: a toner container 111, a photosensitive drum 1, a charging roller 2, a developing roller 4, a supply roller 5, a developing blade 6, a cleaning device 8, and a waste toner container 112.

The toner container 111 works as a developer container and contains toner inside the toner container 111. The photosensitive drum 1 works as an image carrier. The photosensitive drum 1 is rotatably supported. The photosensitive drum 1 forms an electrostatic latent image by being selectively exposed by the light source 3 (Y, M, C, K, T) illustrated in FIG. 1. The charging roller 2 works as a charging device, and electrically charges the surface of the photosensitive drum 1 evenly.

The developing roller 4 works as a development member. The developing roller 4 forms a toner image by: conveying toner to the electrostatic latent image formed on the photosensitive drum 1; and developing the electrostatic latent image with the toner. The supply roller 5 works as a developer supply member and supplies the toner to the developing roller 4. The developing blade 6 works as a developer regulation member and forms an even toner layer on the developing roller 4.

The cleaning device 8 works as a developer removal member, and scrapes residual toner, such as toner not transferred and remaining on the photosensitive drum 1. The waste toner container 112 works as a waste developer container and contains the toner that the cleaning device 8 scrapes.

The charging roller 2, the developing roller 4 and the cleaning device 8 are arranged pressed against the surface of the photosensitive drum 1 while keeping their respective contact amounts. The developing blade 6 and the supply roller 5 are arranged pressed against the developing roller 4 while keeping their respective contact amounts.

The developing roller 4 is a semiconducting elastic layer formed on the circumferential surface of a cylindrical metal shaft. The elastic layer is made of urethane rubber. The surface of the elastic layer is treated with isocyanate for the purpose of increasing its chargeability. The supply roller 5 is a semiconducting foamed elastic layer formed on the circumferential surface of a cylindrical metal shaft. The foamed elastic layer is made of silicone rubber that is good at abrasion resistance.

The developing blade 6 is a SUS plate folded in the form of the letter L. The developing blade 6 is arranged such that: a longitudinal portion of the developing blade 6 is downstream of the developing roller 4 in the rotational direction of the developing roller 4 that is indicated by an arrow in FIG. 3; and a folded edge portion of the developing blade 6 is pressed against the developing roller 4 in a direction counter to the rotational direction of the developing roller 4.

Figure 4:
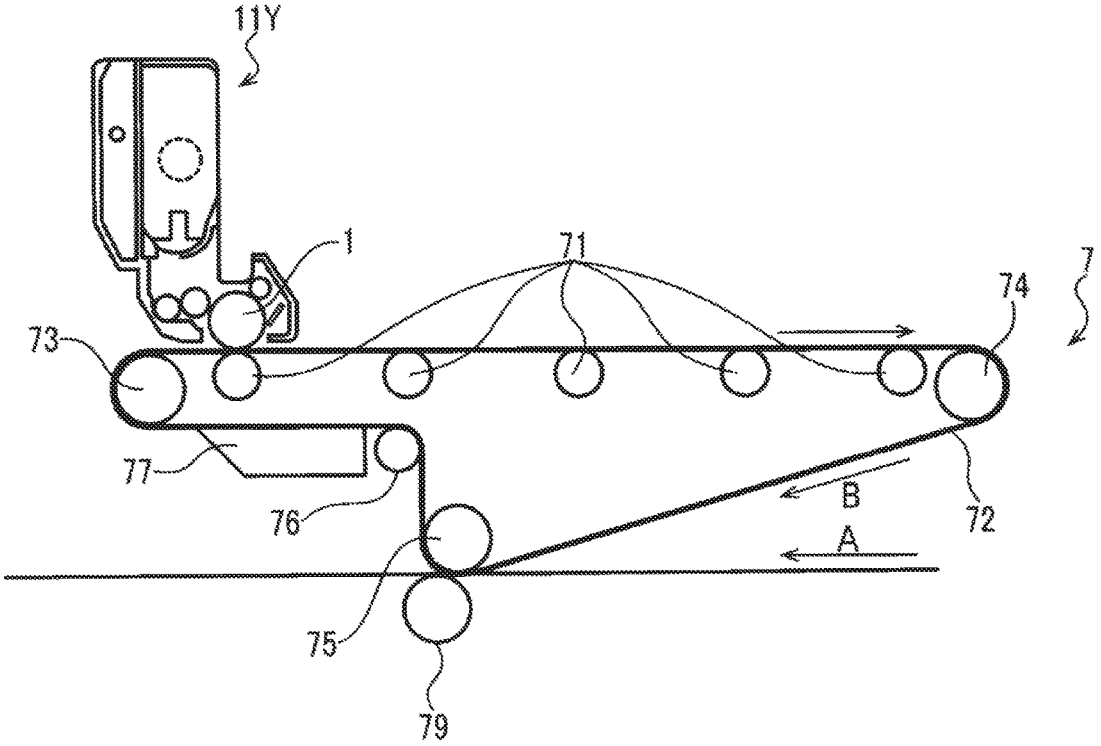
FIG. 4 is a schematic side cross-sectional view illustrating a configuration of an intermediate transfer unit of the image formation apparatus illustrated in FIG. 1.

FIG. 4 is a schematic side cross-sectional view illustrating a configuration of the intermediate transfer unit. In FIG. 4, the intermediate transfer unit 7 includes primary transfer rollers 71, the belt 72, a driving roller 73, support rollers 74, 75, a reverse indentation roller 76, and a waste toner box 77.

The primary transfer rollers 71 are arranged facing the photosensitive drums 1 of the developing units (see FIG. 3), respectively, with the belt 72 interposed in between. The primary transfer rollers 71 transfer the toner images, formed on the respective photosensitive drums 1, onto the belt 72.

The belt 72 is an endless rotatable belt that is stretched and suspended by the driving roller 73, the support rollers 74, 75, and the reverse indentation roller 76. The belt 72 conveys the toner images. A driving source such as a motor drives the driving roller 73. Thereby, the driving roller 73 rotates the belt 72 in a rotational direction indicated by an arrow B in FIG. 4.

The support rollers 74, 75 are driven rollers. The support rollers 74, 75, together with the driving roller 73, stretch and suspend the belt 72 with a predetermined stretch/suspension force.

The reverse indentation roller 76 reversely indents the belt 72. The waste toner box 77 scrapes toners remaining on the belt 72 and contains the scraped toners, when the secondary transfer roller 79 transfers the toner images from the belt 72 onto the print medium 80.

Figure 5:
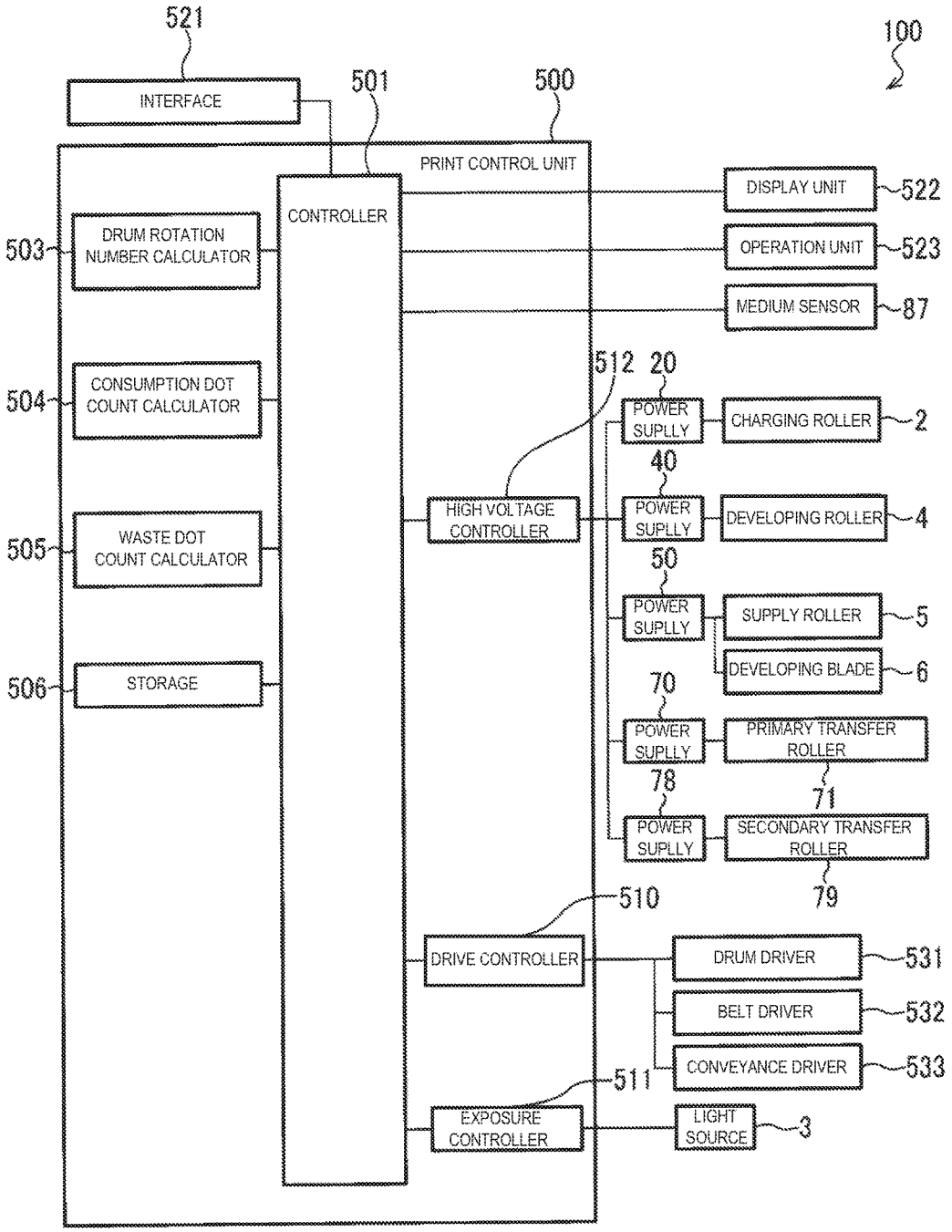
FIG. 5 is a block diagram illustrating an example of a control configuration of the image formation apparatus.

FIG. 5 is a block diagram illustrating an example of a control configuration of the image formation apparatus. In FIG. 5, the image formation apparatus 100 includes a print control unit 500, an interface 521, a display unit 522 (or a display), an operation unit 523, the medium detection sensor 87, power supplies 20, 40, 50, 70, 78, a drum driver 531, a belt driver 532 and a conveyance driver 533.

The interface 521 sends and receives various control signals, as well as information, to and from a host computer as an external apparatus connected to a communication line. The interface 521 receives print data and the like for a print instruction from the host computer.

The display unit 522 includes a display member such as a display and displays information and the like about conditions of the image formation apparatus 100. When one of the developing units 11, consumables, illustrated in FIG. 1 comes to the end of its life or the time for replacement, the display unit 522 displays a warning and the like to recommend the replacement of the developing unit 11 to the user of the image formation apparatus 100.

The operation unit 523 includes input devices such as manipulation buttons and a touch panel. The operation unit 523 receives a user's input. For example, the operation unit 523 receives the user's setting manipulation to set whether to continue printing or not when one of the developing units 11, consumables, is determined to come to the time for replacement during the printing operation. In an embodiment, the operation unit 523 receives the user's setting manipulation for choosing whether to continue printing or not in case that it is determined that the developing unit 11 comes to the time for replacement during the printing operation; and pre-stores in the storage 506 setting information about whether to continue printing or not when it is determined that the developing unit 11 comes to the time for replacement during the printing operation.

The print control unit 500 controls the printing operation that the image formation apparatus 100 performs. The print control unit 500 includes a controller 501, a drum rotation number calculator 503, a consumption dot count calculator 504, a waste dot count calculator 505, a storage 506, a high voltage controller 512, a drive controller 510 and an exposure controller 511.

The controller 501 includes circuits of a central processing unit (CPU) and the like. Based on a control program stored in the storage 506, the controller 501 controls the operations of the image formation apparatus 100.

The controller 501 sends and receives signals to and from the display unit 522, the operation unit 523 and the medium detection sensor 87.

The drum rotation number calculator 503, the consumption dot count calculator 504 and the waste dot count calculator 505 work as a used condition detector (a used amount detector), and detect used conditions of the respective developing units 11 illustrated in FIG. 1.

The drum rotation number calculator 503 works as a rotation number measurement unit. The drum rotation number calculator 503 measures the number of rotations of the photosensitive drum 1 illustrated in FIG. 3 controlled to be rotated by the drive controller 510. In an embodiment, the drum rotation number calculator 503 measures each five rotations of the photosensitive drum 1 with an outer diameter of 30 mm as one drum count (471.2 mm). The drum rotation number calculator 503 measures what are drum counts Ry, Rm, Rc, Rk, Rt of the respective developing units 11 (11Y, 11M, 11C, 11K, 11T) illustrated in FIG. 1.

It should be noted that: the drum count Ry is a cumulative value of drum counts of the developing unit 11Y; the drum count Rm is a cumulative value of drum counts of the developing unit 11M; the drum count Rc is a cumulative value of drum counts of the developing unit 11C; the drum count Rk is a cumulative value of drum counts of the developing unit 11K; and the drum count Rt is a cumulative value of drum counts of the developing unit 11T.

When the drum count Rn (one of the drum counts Ry, Rm, Rc, Rk, Rt) measured by the drum rotation number calculator 503 reaches a threshold of 20,000, the controller 501 determines that the corresponding developing unit 11 comes to the time for replacement.

The consumption dot count calculator 504 works as a consumption amount measurement unit. The consumption dot count calculator 504 measures an amount of toner used to develop the electrostatic latent image that the photosensitive drum 1 illustrated in FIG. 3 forms. For each print job, the consumption dot count calculator 504 calculates consumption dot counts Dy, Dm, Dc, Dk, Dt of the respective the developing units 11 (11Y, 11M, 11C, 11K, 11T) illustrated in FIG. 1, based on the print data that the interface 521 receives. The consumption dot count calculator 504 calculates the consumption dot count Dy by: obtaining an amount of used yellow (Y) toner based on the print data; and converting the used amount into a dot-based value. For each other color toner, similarly, the consumption dot count calculator 504 calculates the consumption dot count Dn by obtaining an amount of used toner.

It should be noted that: the consumption dot count Dy is a cumulative value of consumption dot counts of the developing unit 11Y; the consumption dot count Dm is a cumulative value of consumption dot counts of the developing unit 11M; the consumption dot count Dc is a cumulative value of consumption dot counts of the developing unit 11C; the consumption dot count Dk is a cumulative value of consumption dot counts of the developing unit 11K; and the consumption dot count Dt is a cumulative value of consumption dot counts of the developing unit 11T.

In an embodiment, each time an image with a printed area ratio to a sheet in A4 size (210 mm×297 mm) of 5% duty is printed on the sheet, an amount of toner corresponding to a consumption dot count of 792 is defined as consumed.

When the consumption dot count Dn (one of the consumption dot counts Dy, Dm, Dc, Dk, Dt) measured by the consumption dot count calculator 504 reaches a threshold of Ser. No. 15/840,000, the controller 501 determines that the corresponding developing unit 11 comes to the time for replacement. In this respect, the threshold of 15,840,000 corresponds to 20,000 copies of an image with a printed area ratio to a sheet in A4 size of 5% duty.

The waste dot count calculator 505 works as a waste amount measurement unit, and measures amounts of toners disposed of. Each toner disposed of is residual toner on the corresponding photosensitive drum 1 that the cleaning device 8 illustrated in FIG. 3 scrapes, and that the waste toner container 112 contains.

For the developing units 11 (11Y, 11M, 11C, 11K, 11T) illustrated in FIG. 1, respectively, the waste dot count calculator 505 calculates waste dot counts Wy, Wm, Wc, Wk, Wt from primary transfer residue efficiencies Hn of the toners remaining on the photosensitive drums 1 and back transfer efficiencies Ln of the toners back-transferred onto the photosensitive drums 1 in the intermediate transfer unit 7 illustrated in FIG. 4 where the primary transfer rollers 71 transfer the toner images onto the belt 72, based on the consumption dot counts Dn that the consumption dot count calculator 504 calculates.

It should be noted that: the waste dot count Wy is a cumulative value of waste dot counts of the developing unit 11Y; the waste dot count Wm is a cumulative value of waste dot counts of the developing unit 11M; the waste dot count Wc is a cumulative value of waste dot counts of the developing unit 11C; the waste dot count Wk is a cumulative value of waste dot counts of the developing unit 11K; and the waste dot count Wt is a cumulative value of waste dot counts of the developing unit 11T.

The back transfer means that in the intermediate transfer unit 7 illustrated in FIG. 1, a toner image transferred onto the belt 72 in a developing unit on the upstream side in the rotational direction of the belt 72 adheres to a photosensitive drum(s) in an developing unit(s) on the downstream side while passing through the developing unit(s) on the downstream side.

Table 1 illustrates the primary transfer residue efficiencies Hn and the back transfer efficiencies Ln. The primary transfer residue efficiencies Hn and the back transfer efficiencies Ln are different from one toner color to another, as illustrated in Table 1.

TABLE 1

| | Hn | Ln |
|---|---|---|
| Yellow | 1.5% | — |
| Magenta | 2% | 5% |
| Cyan | 1.5% | 5% |
| Black | 1.5% | 4% |
| Feature Color | 2.5% | 8% |

Next, descriptions are provided for how each waste dot count is calculated.

As for the developing units 11, the developing unit 11Y for yellow, the developing unit 11M for magenta, the developing unit 11C for cyan, the developing unit 11K for black, and the developing unit 11T for a feature color are arranged in this order from the upstream in the rotational direction of the belt 72 in the intermediate transfer unit 7, as illustrated in FIG. 1.

The waste dot count Wy of the developing unit 11Y for yellow is calculated from the consumption dot count Dy and the primary transfer residue efficiency Hy by use of the following equation, since no developing unit exists upstream of the developing unit 11Y.

$$Wy=Dy\times Hy.$$

The waste dot count Wm of the developing unit 11M for magenta is calculated from the consumption dot counts Dy, Dm, the primary transfer residue efficiencies Hy, Hm and the back transfer efficiency Lm by use of the following equation, since one developing unit exists upstream of the developing unit 11M.

$$Wm=Dm\times Hm+Dy\times(1-Hy)\times Lm.$$

The waste dot count We of the developing unit 11C for cyan is calculated from the consumption dot counts Dy, Dm, Dc, the primary transfer residue efficiencies Hy, Hm, Hc, and the back transfer efficiencies Lm, Lc by use of the following equation, since two developing units exist upstream of the developing unit 11C.

$$Wc=Dc\times Hc+[Dy\times(1-Hy)\times(1-Lm)+Dm\times(1-Hm)]\times Lc.$$

The waste dot count Wk of the developing unit 11K for black is calculated from the consumption dot counts Dy, Dm, Dc, Dk, the primary transfer residue efficiencies Hy, Hm, Hc, Hk and the back transfer efficiencies Lm, Lc, Lk by use of the following equation, since three developing units exist upstream of the developing unit 11K.

$$Wk=Dk\times Hk+[Dy\times(1-Hy)\times(1-Lm)\times(1-Lc)+Dm\times(1-Hm)\times(1-Lc)+Dc\times(1-Hc)]\times Lk.$$

The waste dot count Wt of the developing unit 11T for the feature color is calculated from the consumption dot counts Dy, Dm, Dc, Dk, Dt, the primary transfer residue efficiencies Hy, Hm, Hc, Hk, Ht and the back transfer efficiencies Lm, Lc, Lk, Lt by use of the following equation, since four developing units exist upstream of the developing unit 11K.

$$Wt=Dt\times Ht+[Dy\times(1-Hy)\times(1-Lm)\times(1-Lc)\times(1-Lk)+Dm\times(1-Hm)\times(1-Lc)\times(1-Lk)+Dc\times(1-Hc)\times(1-Lk)+Dk\times(1-Hk)]\times Lt.$$

The foregoing embodiment describes the configuration in which the image formation apparatus 100 includes the five developing units. In a case where the image formation apparatus 100 includes four or less developing units, or six or more developing units, the waste dot counts can be calculated using the same calculation method.

Determination on whether the developing unit 11 comes to the time for replacement using the waste dot count depends on the capacity of the waste toner container 112 illustrated in FIG. 3. When the waste dot count Wn (one of the waste dot counts Wy, Wm, Wc, Wk, Wt) measured by the waste dot count calculator 505 reaches a threshold of 9,504,000 (60% of the consumption dot counter Dn), the controller 501 determines that the developing unit 11 comes to the time for replacement.

The storage 506 is a storage device such as a memory. The storage 506 stores control programs that the controller 501 executes, as well as information about various controls and information about various settings that are needed to control the operation of the image formation apparatus 100.

The storage 506 further stores: the drum counts Rn (Ry, Rm, Rc, Rk, Rt) that the drum rotation number calculator 503 calculates; the consumption dot counts Dn (Dy, Dm, Dc, Dk, Dt) that the consumption dot count calculator 504 calculates; and the waste dot counts Wn (Wy, Wm, Wc, Wk, Wt) that the waste dot count calculator 505 calculates.

The storage 506 further stores: a threshold Rlimit for determining whether a developing unit comes to the time for replacement by use of the drum count Rn; a threshold Dlimit for determining whether a developing unit comes to the time for replacement by use of the consumption dot count Dn; and a threshold Wlimit for determining whether a developing unit comes to the time for replacement by use of the waste dot count Wn.

The high voltage controller 512 controls the power supply 20 connected to the charging rollers 2, the power supply 40 connected to the developing rollers 4, the power supply 50 connected to the supply rollers 5 and the developing blades 6, the power supply 70 connected to the primary transfer rollers 71, and the power supply 78 connected to the secondary transfer roller 79. Thereby, the high voltage controller 512 controls voltages applied to the charging rollers 2, the developing rollers 4, the supply rollers 5, the developing blades 6, the primary transfer rollers 71, and the secondary transfer roller 79.

The drive controller 510 controls the drum driver 531, the belt driver 532 and the conveyance driver 533.

The drum driver 531 drives the photosensitive drum 1 of the developing unit 11 illustrated in FIG. 3. Furthermore, the belt driver 532 drives the belt 72 of the intermediate transfer unit 7 illustrated in FIG. 4. Moreover, the conveyance driver 533 drives the conveyance rollers 82*a* to 82*e* illustrated in FIG. 1 that are arranged on the conveyance path along which the continuous medium is conveyed. The exposure controller 511 controls the light sources 3.

As discussed above, the controller 501 controls the drum rotation number calculator 503, the consumption dot count calculator 504, the waste dot count calculator 505, the storage 506, the high voltage controller 512, the drive controller 510, and the exposure controller 511. Based on results of detecting the used conditions of the respective developing units 11 (see FIG. 1) using the drum rotation number calculator 503, the consumption dot count calculator 504 and the waste dot count calculator 505, the controller 501 determines whether one of the developing units 11 comes to the time for replacement. Furthermore, when it is determined that the developing unit 11 comes to the time for replacement during a printing operation, the controller 501 chooses whether to continue the printing operation based on the results of the detections using the drum rotation number calculator 503, the consumption dot count calculator 504 and the waste dot count calculator 505.

To put it more specifically, the controller 501 chooses whether to continue the printing operation, when: determining that the developing unit 11 does not come to the time for replacement based on the amounts of toners that the consumption dot count calculator 504 and the waste dot count calculator 505 measure; and determining that the developing unit 11 comes to the time for replacement based on the number of rotations that the drum rotation number calculator 503 measures.

The foregoing embodiment detects the amount of toner in each developing unit using the method of calculating the amount of used toner and the amount of waste toner based on the dot counts. Any other method may be used as long as the method makes it possible to detect the amount of toner in the developing unit. For example, it is possible to use a method of detecting the amount of toner based on difference in the falling speed of a crank bar that is allowed to rotate inside the toner container 111 of the developing unit 11 illustrated in FIG. 3, a method of detecting the amount of toner based on the transmittance of a laser light beam or the like that is emitted into the developing unit 11 via a prism, or similar methods.

Descriptions are provided for how the foregoing configuration works. Based on FIG. 1, descriptions are provided for how the image formation apparatus performs the printing operation on the continuous print medium. To begin with, descriptions are provided for how the image formation apparatus works to convey the continuous print medium 80 that is unwound from a roll of print medium.

The conveyance rollers 82*a* to 82*c* and the pinch rollers 83*a* to 83*c*, rotated by the driving unit such as a motor, draw the print medium 80 from a roll of print medium that the medium holder 81 holds, and convey the print medium 80 to the intermediate transfer unit 7 with the print medium 80 held between the conveyance rollers 82*d* and 82*e* and the pinch rollers 83*d* and 83*e*.

In the intermediate transfer unit 7, the secondary transfer roller 79 transfers the toner images, developed on the belt 72, onto the print medium 80.

The conveyance rollers 82*a* to 82*e* and the pinch rollers 83*a* to 83*e* convey the print medium 80 with the toner images transferred thereon to the fixation unit 9. By applying heat and pressure to the toner images, the fixation unit 9 fixes the toner images on the print medium 80. The conveyance rollers 82*a* to 82*e* and the pinch rollers 83*a* to 83*e*, rotated by the driving unit, convey the print medium 80 with the toner images fixed thereon to the winding holder 85 with the print medium 80 held between the conveyance rollers 82*a* to 82*e* and the pinch rollers 83*a* to 83*e*.

The winding holder 85, rotating in a winding direction (a counterclockwise rotational direction) indicated by the corresponding arrow in FIG. 1, winds the print medium 80, conveyed to the winding holder 85, into a roll. In the foregoing embodiment, the winding holder 85 winds the print medium 80 in the counterclockwise rotational direction with the printed surface facing outwards. The winding holder 85, however, may wind the print medium 80 in the clockwise rotational direction with the printed surface facing inwards.

Next, descriptions are provided for how each developing unit works to form the toner image, based on FIG. 3, and referring to FIG. 5.

The drive of the drum driver 531 rotates the photosensitive drum 1 of the developing unit 11 in the counterclockwise rotational direction indicated by the corresponding arrow in FIG. 3. The power supply 20 applies a voltage to the charging roller 2, which electrically charges the surface of the photosensitive drum 1 evenly at an electric potential of approximately −600 V.

Depending on the print data, the light source 3 emits light onto the surface of the photosensitive drum 1 that the charging roller 2 electrically charges. The light emission makes the electric potential of the surface of the photosensitive drum 1 range from 0 to minus 600 V, and makes the photosensitive drum 1 form the electrostatic latent image on its surface. Meanwhile, the weight of the toner, filled in the toner container 111, carries the toner to the supply roller 5 by moving the toner downwards. Alternatively, a conveyance member may convey the toner to the supply roller 5.

The photosensitive drum 1 transmits the drive to the developing roller 4 and the supply roller 5 via gears or the like. Thus, the developing roller 4 and the supply roller 5 rotate in the clockwise rotational direction indicated by the corresponding arrows in FIG. 3. Thereby, the supply roller 5 conveys the toner to the developing roller 4.

During the conveyance of the toner, the developing roller 4, the supply roller 5 and the developing blade 6 rub and triboelectrically charge the toner. The toner accordingly becomes negatively charged.

Meanwhile, the power supply 50 applies a voltage of −250 to −400 V to the supply roller 5 and the developing blade 6, while the power supply 40 applies a voltage to −100 to −200 V to the developing roller 4. This causes a potential difference between the supply roller 5 and the developing roller 4, as well as a potential difference between the developing roller 4 and the developing blade 6. Because of these potential differences, the Coulomb forces convey the negatively charged toner from the supply roller 5 to the developing roller 4.

The toner, conveyed to the developing roller 4, forms a layer on the developing roller 4. The layer varies in thickness. The edge portion of the developing blade 6, therefore, scrapes excessive toner on the developing roller 4, and thereby selects the negatively charged toner to form an even toner layer on the developing roller 4.

Because of a potential difference between the developing roller 4 and the photosensitive drum 1, the Coulomb force conveys the toner of the toner layer evenly formed on the developing roller 4 to the electrostatic latent image, an exposed portion on the photosensitive drum 1. Thereby, the toner image is developed. The power supply 70 applies a voltage of +800 to +1600 V to the primary transfer roller 71. A potential difference between the photosensitive drum 1 and the primary transfer roller 71 transfers the toner image, formed on the photosensitive drum 1, from the surface of the photosensitive drum 1 to the print medium 80.

The cleaning device 8 scrapes toner that is not transferred onto the print medium 80 and remains on the photosensitive drum 1, and thereby cleans the photosensitive drum 1. The scraped toner is waste toner. A waste toner conveyance member conveys the scraped toner into the waste toner container 112.

Figure 6:
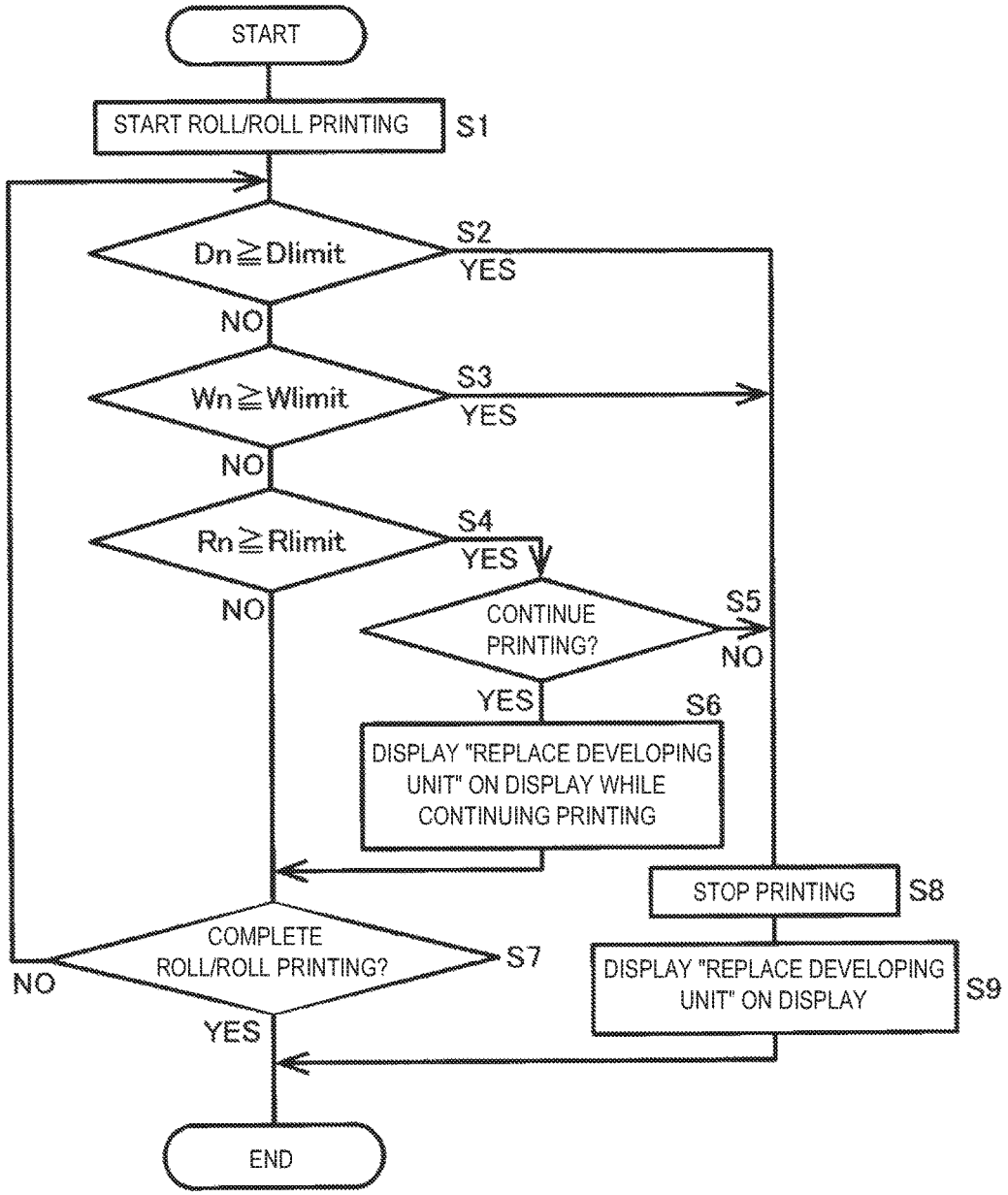
FIG. 6 is a flowchart illustrating an example of a flow of a printing process that the image formation apparatus performs.

Next, referring to FIGS. 1, 3 and 5, descriptions are provided for how the image formation apparatus performs a printing process when the developing unit comes to the time for replacement during a printing operation, in accordance with the sequence of steps whose reference signs begin with S in a flowchart in FIG. 6 that illustrates an example of a flow of the printing process.

S1: The controller 501 in the print control unit 500 of the image formation apparatus 100 starts the roll/roll printing in which: based on the print data that the interface 521 receives from the external apparatus, the image formation apparatus 100 forms images on the print medium 80 while unwinding the print medium 80 from a roll of print medium that the medium holder 81 holds; and the image formation apparatus 100 winds the print medium 80 with the images formed thereon into a roll using the winding holder 85.

Once starting the roll/roll printing, the controller 501 causes the drum rotation number calculator 503 to start to calculate the drum counts Rn (Ry, Rm, Rc, Rk, Rt), the consumption dot count calculator 504 to start to calculate the consumption dot counts Dn (Dy, Dm, Dc, Dk, Dt), and the waste dot count calculator 505 to start to calculate the waste dot counts Wn (Wy, Wm, Wc, Wk, Wt).

S2: The controller 501 determines whether the consumption dot count Dn (one of Dy, Dm, Dc, Dk, Dt) is not less than the threshold Dlimit. If the controller 501 determines that the consumption dot count Dn is not less than the threshold Dlimit, the controller 501 proceeds to a process in step S8. If the controller 501 determines that the consumption dot count Dn is less than the threshold Dlimit, the controller 501 proceeds to a process in step S3.

If the consumption dot count Dn the threshold Dlimit, the amount of remaining toner in the developing unit 11 is smaller, and continuation of the printing makes the print quality worse. The controller 501, therefore, proceeds to the process in step S8 to stop the printing. On the other hand, if the consumption dot count Dn<the threshold Dlimit, the amount of toner in the developing unit 11 is sufficient. The controller 501, therefore, proceeds to step S3 to continue the process.

S3: The controller 501 determines whether the waste dot count Wn (one of Wy, Wm, Wc, Wk, Wt) is not less than the threshold Wlimit. If the controller 501 determines that the waste dot count Wn is not less than the threshold Wlimit, the controller 501 proceeds to the process in step S8. If the controller 501 determines that the waste dot count Wn is less than the threshold Wlimit, the controller 501 proceeds to a process in step S4.

If the waste dot count Wn the threshold Wlimit, the amount of toner in the waste toner container 112 is large, and there is likelihood that the waste toner spills out of the waste toner container 112 onto the print medium to smear the print medium. The controller 501, therefore, proceeds to the process in step S8 to stop the printing. On the other hand, if the waste dot count Wn<the threshold Wlimit, a space large enough to contain toner is secured in the waste toner container 112. The controller 501, therefore, proceeds to step S4 to continue the process.

As discussed above, when based on the amounts of toners that the consumption dot count calculator 504 and the waste dot count calculator 505 measure, the controller 501 determines that the developing unit 11 comes to the time for replacement, the controller 501 proceeds to the process in step S8 to stop the printing operation.

S4: The controller 501 determines whether the drum count Rn (one of Ry, Rm, Rc, Rk, Rt) is not less than the threshold Rlimit. If the controller 501 determines that the drum count Rn is not less than the threshold Rlimit, the controller 501 proceeds to a process in step S5. If the controller 501 determines that the drum count Rn is less than the threshold Rlimit, the controller 501 proceeds to a process in step S7.

If the drum count Rn the threshold Rlimit, the photosensitive drum 1, the developing roller 4 and the supply roller 5 in the developing unit 11 are worn out. Their wear reduces the toner conveying capability and the efficiency of developing electrostatic latent images, and thus decreases the toner concentration. In other words, if the drum count Rn the threshold Rlimit, performance deteriorations of the developing roller 4 and/or the supply roller 5 are assumed to exceed the limits. The controller 501, therefore, proceeds to a process in step S5 to determine whether to continue the printing. On the other hand, if the drum count Rn<the threshold Rlimit, the photosensitive drum 1, the developing roller 4 and the supply roller 5 in the developing unit 11 are not worn so much, and the toner concentration is stable. The controller 501, therefore, proceeds to step S7 to continue the process.

S5: The controller 501, having determined that the drum count Rn is not less than the threshold Rlimit, reads the beforehand-set information on whether to continue the printing from the storage 506. If the controller 501 determines that the user has set information for continuing the printing (setting instructing the continuation), the controller 501 proceeds to a process in step S6 to continue the printing. On the other hand, if the controller 501 determines that the user has set information for not continuing the printing, the controller 501 proceeds to the process in step S8 to stop the printing. Incidentally, in advance of starting the roll/roll printing, the user inputs and sets the information on whether to continue the printing; the operation unit 523 receives the user's manipulation to input the information on whether to continue the printing; and the storage 506 stores the information.

In this respect, the operation unit 523 receives the user' manipulation to input his/her choice of whether to continue the printing by detecting the user's pressing down of buttons in the operation unit 523. In the case where the user wants to have a setting to continue the printing when the drum count Rn (one of Ry, Rm, Rc, Rk, Rt) becomes equal to or greater than the threshold Rlimit during the printing operation, the user presses down a button for instructing the image formation apparatus 100 to continue the printing. In the case where the user wants to have a setting to stop the printing when the drum count Rn (one of Ry, Rm, Rc, Rk, Rt) becomes equal to or greater than the threshold Rlimit during the printing operation, the user presses down a button for instructing the image formation apparatus 100 to stop the printing.

S6: The controller 501, having detected the input manipulation for continuing the printing, displays a message, such as "Replace Developing Unit," on the display unit 522 to recommend the replacement of the developing unit 11 to the user while continuing the printing operation. The controller 501 also proceeds to the process in step S7.

S7: The controller 501 determines whether the image formation apparatus 100 has completed the roll/roll printing based on the print data. If the controller 501 determines that the image formation apparatus 100 has not completed the roll/roll printing yet, the controller 501 proceeds to a process in step S2 to repeat the printing process. If the controller 501 determines that the image formation apparatus 100 has completed the roll/roll printing, the controller 501 terminates the printing process.

S8: The controller 501 registers a part of the print medium 80 on which the image formation apparatus 100 is forming images when the developing unit 11 comes to the time for replacement, as the last page. The controller 501 interrupts the exposure of the photosensitive drum 1 and stops the printing operation on the print medium based on the print data.

It should be noted that the controller 501 continues the printing operation until: the photosensitive drums 1 develop the latent images for the last page; the primary transfer rollers 71 transfer the developed images onto the belt 72 in the intermediate transfer unit 7; the secondary transfer roller 79 transfers the images onto the print medium from the belt 72; the fixation unit 9 fixes the images onto the print medium; and the last page with the images fixed thereon passes under the conveyance roller 82*e*. Once the last page passes under the conveyance roller 82*e*, the controller 501 stops the printing operation.

In the case of the suspension of the printing operation, therefore, the conveyance rollers 82*a* to 82*e* need to continue conveying the print medium until the last page passes under the conveyance roller 82*e*. Thus, the image formation apparatus 100 does not print on a length of print medium that corresponding to at least the distance from the conveyance roller 82*a* to the conveyance roller 82*e*. This length of print medium is useless.

S9: The controller 501 displays a message, such as "Replace Developing Unit," on the display unit 522 to recommend the replacement of the developing unit 11 to the user. Thereafter, the controller 501 terminates the printing process.

Figure 7:
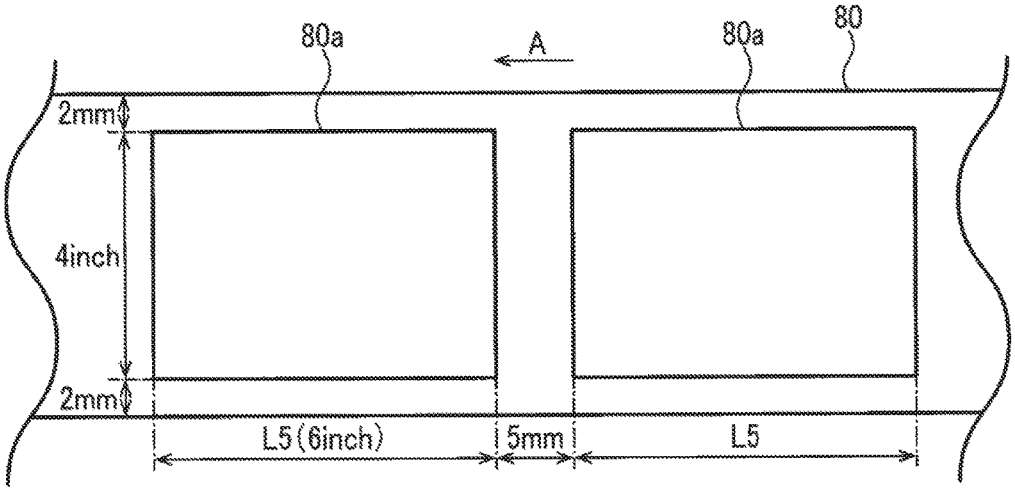
FIG. 7 is a diagram for explaining an example of a print medium that the image formation apparatus uses.
Figure 8:
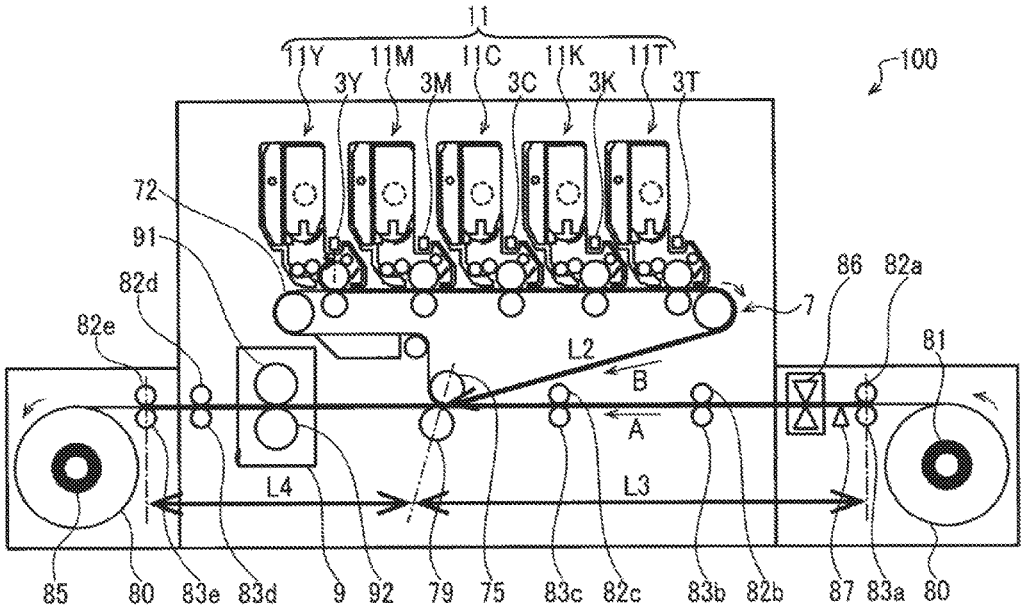
FIG. 8 is a diagram for explaining how the image formation apparatus produces waste paper.

Next, referring to FIG. 7 that is an explanatory diagram of the print medium and FIG. 8 that is an explanatory diagram of waste paper portion, descriptions are provided for how long a print medium becoming useless because of not be printed is both in the case where the image formation apparatus 100 stops the printing operation while performing it and in the case where the image formation apparatus 100 continues the printing operation. The descriptions are provided using a case where the image formation apparatus 100 is a printer corresponding to the print medium 80 that has labels each with a width of 4 inches.

As illustrated in FIG. 7, the roll-shaped print medium 80 in use includes a substrate, and label parts 80*a* provided on the substrate. The transverse width (the length in the transverse direction orthogonal to the medium conveyance direction indicated by an arrow A in FIG. 7) is 4 inches+4 mm. Incidentally, in each of the two transverse side portions of the print medium 80, a 2-mm margin is provided between the transverse end of each label part 80*a* and the transverse end of the substrate. Furthermore, the transverse length of each label part 80*a* is 4 inches; the longitudinal (coinciding with the medium conveyance direction indicated by the arrow A in FIG. 7) length L5 of the label part 80*a* is 6 inches; and the distance between each two neighboring label parts 80*a* is 5 mm. Moreover, the print medium 80 is a label medium (for example, <70>PW manufactured by Lintec Corporation) made of wood-free paper with a unit weight of 81.4 g/m$^2$.

Meanwhile, the printing speed is 6 ips (inches per second), that is, 152.4 mm/s. Before starting the printing operation, the leading edge of the print medium 80 unwound from a roll that medium holder 81 of the image formation apparatus 100 is held between the conveyance roller 82*a* and the pinch roller 83*a*.

Based on a received signal, the image formation apparatus 100 starts an initial (initialization) operation. During the initial operation, the controller 501 causes the developing units 11, the intermediate transfer unit 7 and the fixation unit 9 to perform an idling operation. In the embodiment, an idling operation time is set at 20 seconds, which is equivalent to a print medium conveyance distance L1 of 3048 mm.

During the initial operation, the conveyance rollers 82*a* to 82*b* do not have to convey the print medium 80 as long as the conveyance roller 82*a* and the pinch roller 83*a* hold the leading edge of the print medium 80 in between.

In a case where a part of the print medium 80 has already passed through the inside of the image formation apparatus 100 (the winding holder 85 has already wound the leading edge of the print medium 80), the intermediate transfer unit 7 and the fixation unit 9 are in contact with the print medium 80. During the initial operation, therefore, the intermediate transfer unit 7 and the fixation unit 9 perform the idling operation with the print medium 80 in contact with the intermediate transfer unit 7 and the fixation unit 9. Accordingly, the image formation apparatus 100 conveys the print medium 80 in response to the idling operation.

Once completing the initial operation, the image formation apparatus 100 starts the printing operation based on the received print data. The image formation apparatus 100 causes the developing units 11 to form the respective toner images, and causes the intermediate transfer unit 7 to transfer the toner images onto the print medium 80. To this end, the image formation apparatus 100 adjusts the timing at which the conveyance roller 82*a* starts to convey the print medium 80 and the timing at which a particular developing unit exposes its toner image in order to make the leading edge of the print medium 80 agree with the leading edge of a page onto which the developing units 11 are going to transfer the respective toner images.

As illustrated in FIG. 8, L2=680 mm where L2 represents a distance that a toner image travels to the secondary transfer roller 79 from a place where the light source 3Y of the developing unit 11Y, arranged most upstream in the rotational direction of the belt 72 of the intermediate transfer unit 7, exposes the toner image. In addition, L3=340 mm where L3 represents a distance that the print medium 80 travels to the secondary transfer roller 79 from the conveyance roller 82*a*.

Since the distance L3 is shorter than the distance L2, the timing at which the developing unit 11Y exposes its toner image needs to come earlier than the timing at which the conveyance roller 82*a* starts to convey the print medium 80. The image formation apparatus 100, therefore, starts to drive the conveyance roller 82*a* 2.23 seconds (=(680 mm−340 mm)/152.4 mm/s) after the start of the developing unit 11Y's exposure.

In the case where the winding holder 85 completes winding the leading edge of the print medium 80 before the start of the printing operation, the conveyance rollers 82*a* to 82*e* already convey the print medium 80 during the initial operation. This makes it impossible to make the transfer start timing come later than the exposure timing. The image formation apparatus 100, therefore, causes the conveyance rollers 82*a* to 82*e* to convey the print medium 80 by the distance L2 (=680 mm) that the toner image travels to the secondary transfer roller 79 from the place where the light source 3Y exposes the toner image.

In the case where the conveyance roller 82*a* and the pinch roller 83*a* hold the leading edge of the print medium 80 in between, the image formation apparatus 100 causes the conveyance rollers 82*a* to 82*e* to convey the print medium 80 by the distance L3 (=340 mm) that the print medium 80 travels to the secondary transfer roller 79 from the conveyance roller 82*a*, as illustrated in FIG. 8.

Thereafter, the secondary transfer roller 79 transfers the toner images onto the print medium 80, and the resultant print medium 80 passes through the fixation unit 9. The conveyance rollers 82*a* to 82*e* conveys the print medium 80 by a distance that is a sum of the distance L4 (=164 mm) from the secondary transfer roller 79 and the conveyance roller 82*e* and the length L5 (=152.4 mm (6 inches)) of the label part 80*a* on the print medium 80, and continue conveying the print medium 80 until the trailing edge of the label part pass under the conveyance roller 82*e*.

Thus, in the case where the printing starts with the leading edge of the print medium 80 held between the conveyance roller 82*a* and the pinch roller 83*a*, the distance L of conveyance of the print medium 80 from the start of the printing until the completion of printing one page is given by L=L3+L4+L5. That is, the distance L=656.4 mm.

In contrast, in the case where the printing starts after the image formation apparatus 100 once terminates the printing, the distance L of conveyance of the print medium 80 from the start of the printing until the completion of printing one page is given by L=L1+L2+L4+L5. That is, the distance L=3704.4 mm. This is because a part of the print medium 80 has already passed through the inside of the image formation apparatus 100, and the winding holder 85 has already wound the leading edge of the print medium 80.

Furthermore, in the case where during the roll/roll printing operation, the controller 501 stops the printing based on the determination that the developing unit 11 comes to the time for replacement, the image formation apparatus 100 performs no printing on part of the print medium 80 that is conveyed while the last page is passing from the secondary transfer roller 79 to the conveyance roller 82*e*. This part of the print medium 80 is a useless part, that is, waste paper portion. The length of the part of the print medium 80, discarded as waste paper portion, in the medium conveyance direction is equal to the distance L between the conveyance roller 82*a* to the conveyance roller 82*e*. The distance L is given by L=L3+L4. That is, the distance L=504 mm.

In this respect, let us compare the distance (length) of waste paper portion in the medium conveyance direction between the resumed printing after the suspension and the continued printing under the condition that, during the continuous roll/roll printing operation, the drum count Rm of the developing unit 11 becomes equal to or greater than the threshold Rlimit while the consumption dot count Dn and the waste dot count Wn of the same developing unit 11 are still less than the thresholds Dlimit and Wlimit.

To begin with, Comparative Example 1 of the resumed printing after the suspension is described. Comparative Example 1 is a case where the image formation apparatus 100 temporarily stops the printing operation and thereafter resumes the printing without removing the print medium 80.

In Comparative Example 1, since the winding holder 85 has already wound the leading edge of the print medium 80, waste paper portion is a part of the print medium 80 that is conveyed during the initial operation and is thereafter conveyed until the toner image formed by the developing unit 11 is transferred onto the print medium. The distance L of the waste paper portion, therefore, is given by L=L1+L2. That is, the distance L is 3728 mm.

Next, Comparative Example 2 of the resumed printing after the suspension is described. Comparative Example 2 is a case where the image formation apparatus 100 temporarily stops the printing operation and resumes the printing after a part of the print medium 80 that has passed through the inside of the image formation apparatus 100 is removed. In Comparative Example 2, waste paper portion is a part of the print medium 80, whose length is equal to that of the part of the print medium 80 that has passed through the inside of the image formation apparatus 100, or a distance from the conveyance roller 82*a* to the conveyance roller 82*e*. The distance L of the waste paper portion, therefore, given by L=L3+L4. That is, the distance L is 504 mm.

it should be noted that since the image formation apparatus 100 resumes the print with the leading edge of the print medium 80 held between the conveyance roller 82*a* and the pinch roller 83*e*, the resumption of the printing produces no waste paper portion.

Comparative Example 2 makes the distance of the waste paper portion extremely shorter than Comparative Example 1. Comparative Example 2, however, has a disadvantage that: the roll-shape print medium 80 has to be cut in its middle; and the winding of the print medium 80 by the winding roller 85 divides the print medium 80 into two rolls.

In contrast to Comparative Examples 1, 2 discussed above, the foregoing embodiment produces no waste paper portion since the embodiment does not stops the printing while uninterruptedly performing the continuous printing without stopping the printing. Furthermore, the foregoing embodiment does not cut the roll-shaped print medium 80 in its middle, and accordingly does not divide the print medium 80 into two rolls when the winding roller 85 winds the print medium 80.

In sum, when one of the developing units 11 comes to the time for replacement during the roll/roll printing operation, the controller 501 of the image formation apparatus 100 makes it possible to choose whether to continue the printing operation depending on the consumable that comes to the time for replacement, and the user thereby determines whether to continue the printing operation. The controller 501 of the image formation apparatus 100, therefore, is capable of inhibiting part of the print medium from turning into useless waste paper portion on which nothing is printed.

Furthermore, since the roll-shaped print medium 80 is not cut in its middle, and the winding of the print medium 80 by the winding holder 85 does not divide the print medium 80 into rolls.

Referring to FIGS. 1, 3 and 5, descriptions are hereinbelow provided in accordance with the sequence of steps whose reference signs begin with S in a flowchart in FIG. 9 that illustrates a modification of the flow of the printing process. The modification adds a process of step S6*a* between steps S6, S7 illustrated in FIG. 6.

S1 to S5: Steps S1 to S5 in FIG. 9 are the same as the steps S1 to S5 in FIG. 6, and descriptions for them are omitted.

S6: The controller 501, having detected the input manipulation for continuing the printing, displays a message, such as "Replace Developing Unit," on the display unit 522 to recommend the replacement of the developing unit 11 to the user while continuing the printing operation. The controller 501 also proceeds to a process in step S6*a*.

S6*a*: Based on an input signal from the medium detection sensor 87, the controller 501 determines whether the print medium 80 remains. If the controller 501 determines that no print medium 80 remains, that is, there is no print medium 80 left wound in the roll, the controller 501 proceeds to the process in step S8 to stop the printing and recommend the replacement of the developing unit 11. If the controller 501 determines that the print medium 80 remains, the controller 501 proceeds to the process in step S7 to continue the printing S7 to S9: Steps S7 to S9 in FIG. 9 are the same as the steps S7 to S9 in FIG. 6, and descriptions for them are omitted.

As discussed above, the modification is capable of: continuing the printing as long as the print medium 80 remains; and stopping the printing and recommending the replacement of the developing unit 11 to the user once the image formation apparatus 100 uses up the print medium wound in the roll.

Figure 9:
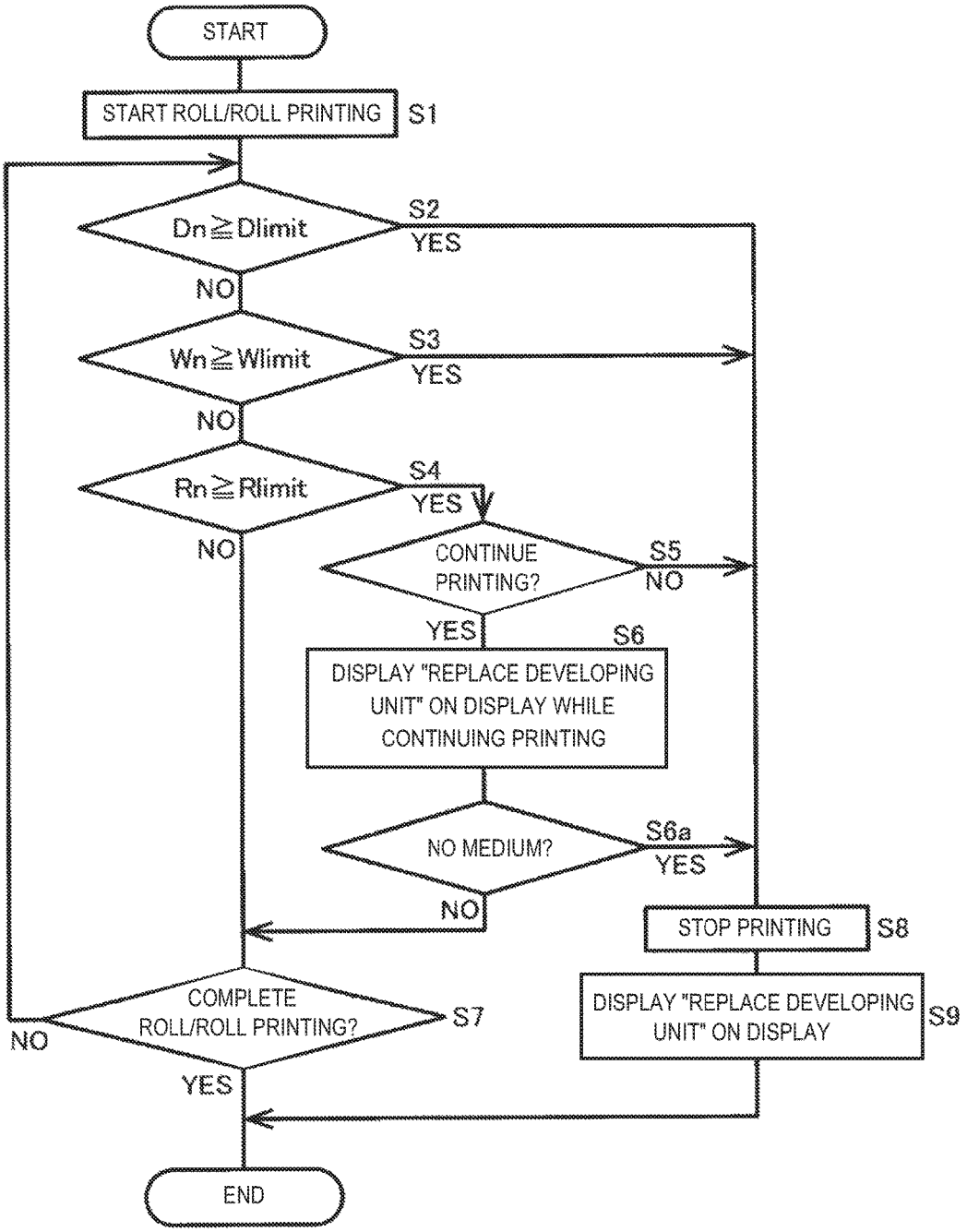
FIG. 9 is a flowchart illustrating a flow of a printing process according to a modification.

It should be noted that the following process may be added to come after the process in step S7 in FIGS. 6 and 9.

Additional Process: The controller 501 determines whether the drum count Rn (one of Ry, Rm, Rc, Rk, Rt) is not less than the threshold Rlimit. If the controller 501 determines that the drum count Rn is not less than the threshold Rlimit, the controller 501 proceeds to the process in step S8 to stop the printing and recommend the replacement of the developing unit 11. If the controller 501 determines that the drum count Rn is less than the threshold Rlimit, the controller 501 terminates this process.

In this case, in step S6, the controller 501 displays a message, such as "Prepare to Replace Developing Unit," on the display unit 522 to recommend the replacement of the developing unit 11 to the user.

Even in a case where the user sets the continuation of the printing, the addition of this process makes it possible for the controller 501 to stop the printing and recommend the replacement of the developing unit 11 to the user in a case where the image formation apparatus 100 completes the roll/roll printing and the drum count Rn is not less than the threshold Rlimit.

Furthermore, in the case where the printing continues in step S6 in FIGS. 6 and 9, the process may be configured such that: the controller 501 displays an instruction message, such as "Press Stop Button to Stop Printing," on the display unit 522; when the controller 501 detects that the user presses the "Stop Button" on the operation unit 523, the controller 501 proceeds to the process in step S7, where the controller 501 recommends the replacement of the developing unit 11 to the user. Incidentally, the "Stop Button" may be a hard key or a key on the touch panel display.

The addition of the process of stopping the printing operation once the operation unit 523 receives an input manipulation for stopping the printing during the continuation of the printing operation makes it possible for the controller 501 to cancel the continuation of the printing based on the user's manipulation.

As discussed above, in the case where the developing unit comes to the time for replacement during the roll/roll printing operation, the foregoing embodiment makes it possible for the user to choose whether to stop the printing operation depending on the consumable whose life comes to the end. The foregoing embodiment, therefore, can inhibit the production of a useless portion of the medium (waste paper portion) when a consumable comes to the time for replacement.

Furthermore, the foregoing embodiment does not cut the roll-shaped print medium in its middle. The foregoing embodiment, therefore, can obtain an effect of not dividing the roll into parts when the winding holder winds the print medium.

The foregoing embodiment has been described on the assumption that the image formation apparatus is the printer. The image formation apparatus is not limited to the printer, and may be a copying machine, a facsimile machine, a multi-function printer (MFP), or the like. Moreover, the invention is not limited to the foregoing embodiment. The invention may be variously modified based on the gist and spirit of the invention, and such modifications are not excluded from the scope of the invention.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus comprising:

a medium holder that holds a continuous medium wound in a roll;

a first pair of conveyance rollers that convey the continuous medium and provide in a medium conveyance path for conveying the continuous medium drawn out from the medium holder, at a position distant from the medium holder, a second pair of conveyance rollers that convey the continuous medium and provide in a downward side in a conveyance direction of the first pair of conveyance rollers;

a medium detection sensor that detects the continuous medium passed through the first pair of conveyance rollers and provides on the medium conveyance path between the first pair of conveyance rollers and the second pair of conveyance rollers;

an image formation unit that forms a developer image on the continuous medium to print on the continuous medium;

a belt that conveys the developer image formed by the image formation unit;

a transfer unit that provides in a downward side in conveyance direction of the second pair of conveyance rollers and transfers the developer image formed by using the image formation unit on the continuous medium;

a used condition detector that detects a used condition of the image formation unit;

a display unit that displays information about conditions of the image formation unit detected by the used condition detector; and a controller that controls the first pair of conveyance rollers, the second pair of conveyance rollers, the medium detection sensor, the image formation unit, the belt, the transfer unit, the used condition detector, and display unit, wherein the transfer unit is arranged to face the belt, the continuous medium is held between the belt and the transfer unit, and the developer image on the belt is transferred on the continuous medium by using the transfer unit, the image formation unit includes at least one developing unit, the developing unit is arranged at the most upstream side in the conveyance direction of the belt and includes a photosensitive drum and a light source, and a distance L3 from the first pair of conveyance rollers to the transfer unit is shorter than a distance L2 that the developer image travels from a place where the light source exposes the developer image to the transfer unit, in response to determining that the image formation unit comes to a time for replacement during a printing operation, the controller selects whether to continue the printing operation based on the detection by the used condition detector, in response to the controller selecting to continue the printing operation, the controller causes the printing operation to continue using the image formation unit while the continuous medium is detected by the medium detection sensor and causes an indication to display on the display unit, the indication prompting to replace the image formation unit, and in response to the medium detection sensor no longer detecting the continuous medium, the controller causes the printing operation using the image formation unit to stop and causes the indication to be displayed on the display unit, the indication prompting to replace the image formation unit.

2. The image formation apparatus according to claim 1, wherein the image formation unit includes a rotatable image carrier that carries thereon an electrostatic latent image, and a development member that develops the electrostatic latent image on the image carrier with a developer, and thereby forms the developer image on the image carrier, the used condition detector includes a rotation number measurement unit that measures a number of rotations of the image carrier, a consumption amount measurement unit that measures an amount of developer used to develop the electrostatic latent image, and a waste amount measurement unit that measures an amount of developer disposed of, and the controller selects whether to continue the printing operation in response to determining that the image formation unit does not come to the time for replacement based on the amounts measured by the consumption amount measurement unit and the waste amount measurement unit, and the image formation unit comes to the time for replacement based on the number of rotations measured by the rotation number measurement unit.

3. The image formation apparatus according to claim 2, further comprising an operation unit that receives an input to store a setting for whether to continue the printing operation in response to determining that the image formation unit comes to the time for replacement, and in response to determining that the image formation unit comes to the time for replacement, the controller determines whether to continue the printing operation based on the stored setting.

4. The image formation apparatus according to claim 3, wherein in response to the operation unit receiving, during the printing operation, an input for stopping the printing operation, the controller stops the printing operation.

5. The image formation apparatus according to claim 2, wherein the controller stops the printing operation, either in response to determining that the image formation unit comes to the time for replacement based on the amount measured by the consumption amount measurement unit or in response to determining that the image formation unit comes to the time for replacement based on the amount measured by the waste amount measurement unit.

6. The image formation apparatus according to claim 1, wherein the image formation unit includes a rotatable image carrier that carries thereon an electrostatic latent image, and a development member that develops the electrostatic latent image on the image carrier with a developer, and thereby forms the developer image on the image carrier, the used condition detector comprises a rotation number measurement unit that measures the number of rotations of the image carrier, a consumption amount measurement unit that measures an amount of developer used to develop the electrostatic latent image, and a waste amount measurement unit that measures an amount of developer disposed of, and the controller determines that the image formation unit comes to the time for replacement in response to an amount measured by the consumption amount measurement unit reaching a first threshold, an amount measured by the waste amount measurement unit reaching a second threshold, or a number of rotations measured by the rotation number measurement unit reaching a third threshold, the controller selects whether to continue the printing operation in response to the amount measured by the consumption amount measurement unit not reaching the first threshold and the amount measured by the waste amount measurement unit not reaching the second threshold, and the number of rotations measured by the rotation number measurement unit reaching the third threshold.

7. The image formation apparatus according to claim 6, wherein the controller stops the printing operation, either in response to the amount measured by the consumption amount measurement unit reaching the first threshold or in response to the amount measured by the waste amount measurement unit measure reaching the second threshold.

8. An image formation apparatus comprising:

a first pair of conveyance rollers that convey a continuous medium, a second pair of conveyance rollers that convey the continuous medium and provide in a downward side in a conveyance direction of the first pair of conveyance rollers;

an image formation unit that forms a developer image on the continuous medium to print on the continuous medium by using a first consumable item and a second consumable item;

a belt that conveys the developer image formed by the image formation unit;

a transfer unit that provides in a downward side in conveyance direction of the second pair of conveyance rollers and transfers the developer image formed by using the image formation unit on the continuous medium;

a display;

an input unit that receives an input regarding whether to continue a printing operation or not;

a used condition detector that detects used conditions of the first consumable item and the second consumable item; and a controller that controls the first pair of conveyance rollers, the second pair of conveyance rollers, the image formation unit, the belt, the transfer unit, a display, an input unit and the used condition detector, wherein the transfer unit is arranged to face the belt, the continuous medium is held between the belt and the transfer unit, and the developer image on the belt is transferred on the continuous medium by using the transfer unit, the image formation unit includes at least one developing unit, the developing unit is arranged at the most upstream side in the conveyance direction of the belt and includes a photosensitive drum and a light source, a distance L3 from the first pair of conveyance rollers to the transfer unit is shorter than a distance L2 that the developer image travels from a place where the light source exposes the developer image to the transfer unit, the controller determines whether the first consumable item comes to a time for replacement based on a remaining amount of the first consumable item, and determines whether the second consumable item comes to a time for replacement based on a performance deterioration of the second consumable item, the remaining amount of the first consumable item and the performance deterioration of the second consumable item based on the used conditions detected by the used condition detector, during a printing operation, in response to the controller determining that the first consumable item does not come to the time for replacement based on the remaining amount of the first consumable item and determining that the second consumable item comes to the time for replacement based on the performance deterioration of the second consumable item, and in response to the input unit receiving an input to continue the printing operation, the controller displays on the display an indication prompting replacement of the second consumable item while continuing the printing operation.

9. The image formation apparatus according to claim 8, wherein in response to the controller determining, during a printing operation, that the first consumable item comes to the time for replacement based on the remaining amount of the first consumable item, the controller stops the printing operation and displays an indication prompting replacement of the first consumable item, and in response to the controller determining, during a printing operation, that the first consumable item does not come to the time for replacement based on the remaining amount of the first consumable item and determining that the second consumable item comes to the time based on the performance deterioration of the second consumable item, and in response to the input unit receiving an input to stop the printing operation, the controller stops the printing operation and displays on the display an indication prompting replacement of the second consumable item.

10. The image formation apparatus according to claim 9, wherein the image formation unit comprises a rotatable image carrier that carries thereon an electrostatic latent image, the used condition detector comprises:

a rotation number measurement unit that measures the number of rotations of the image carrier, a consumption amount measurement unit that measures an amount of developer used to develop the electrostatic latent image, and a waste amount measurement unit that measures an amount of developer disposed of, the remaining amount of the first consumable item is determined based on the amount of developer used and an amount of developer disposed of, and the performance deterioration of the second consumable item is determined based on the number of rotations of the image carrier.

* * * * *